United States Patent [19]

McGahhey

[11] Patent Number: 4,982,591

[45] Date of Patent: Jan. 8, 1991

[54] RAIL RECYCLE PROCESS

[75] Inventor: Darrell B. McGahhey, El Paso, Tex.

[73] Assignee: W. Silver, Inc., El Paso, Tex.

[21] Appl. No.: 286,945

[22] Filed: Dec. 20, 1988

[51] Int. Cl.[5] ..... B21B 1/08

[52] U.S. Cl. ..... 72/234; 72/366.3

[58] Field of Search ..... 72/220, 221, 234, 366, 72/235

[56] References Cited

U.S. PATENT DOCUMENTS

| | | | |
|---|---|---|---|
| 179,379 | 6/1876 | Whitman | 72/221 |
| 180,049 | 7/1876 | McCaffrey | 72/221 |
| 205,074 | 6/1878 | Glaze et al. | 72/221 |
| 328,937 | 10/1885 | Hargreaves . | |
| 676,695 | 6/1901 | Lentz . | |
| 852,983 | 5/1907 | Slick . | |
| 1,086,789 | 2/1914 | Slick . | |
| 1,206,606 | 11/1916 | Slick . | |
| 3,133,343 | 5/1964 | Kratkay | 29/401 |
| 4,123,927 | 11/1978 | Brauer | 72/16 |

FOREIGN PATENT DOCUMENTS

| | | | |
|---|---|---|---|
| 54-118370 | 9/1979 | Japan | 72/234 |

*Primary Examiner*—Lowell A. Larson
*Assistant Examiner*—T. C. Schoeffler
*Attorney, Agent, or Firm*—Fleit, Jacobson, Cohn, Price, Holman & Stern

[57] ABSTRACT

A worn, one-piece rail heated to a plastic state is initially deformed by a multi-stage rolling action to a slab constituted by flattened base and head extensions of an undeformed web portion of the rail. The slab is then edged in stages to effect thicknening of its intermediate portion and formation of a billet without any lapping, seaming or folding.

3 Claims, 3 Drawing Sheets

RAIL RECYCLE PROCESS

BACKGROUND OF THE INVENTION

The recycling of worn railroad rails, which is already widely known, involves heating the rail within a furnace to a plastic state for molding thereof by means of rolling operations. Often, such rolling operations are associated with separate processing of cut portions of the rail, such as its head, web and base. In some instances, all portions of the worn rail are processed along one shaping line into bar products, such as fence posts or rebars.

The recycling of worn rails without cutting thereof has also been proposed, as disclosed for example in U.S. Pat. No. 328,937 to Hargreaves and U.S. Pat. Nos. 852,983, 1,086,789 and 1,206,606 to Slick. Such prior known methods of recycling worn rails have never proved successful in producing a one-piece billet or slab, because of problems created by the formation of laps, seams and folds during the rolling operations, giving rise to quality defects in the product produced.

It is therefore an important object of the present invention to provide a method of effectively deforming a one-piece rail, while heated to a plastic state, by rolling operations which avoid any laps, seams and folds in the formation of billets or any desired cross sectional shape.

SUMMARY OF THE INVENTION

In accordance with the present invention, a heated, one-piece rail, while in a plastic state, is fed through a plurality of separate rolling passes for multi-stage deformation thereof. In the first group of such passes, deformation of the rail is limited to flattening of the base and head portions thereof to produce a slab constituted by the undeformed web portion from which the flattened base and head portions extend. Feed of the rail to and from the foregoing passes is regulated by frictional entry and exit guidance which is progressively tightened as the slab is formed.

The flattened slab, while still in a plastic state, is repeatedly edged by edging rollers in separate passes to thicken the slab between the previously flattened portions. Between such edging passes, the thickened slab is flattened by sizing rollers until a billet or any desired product is formed, such as a rebar.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING FIGURES

FIGS. 5–10 are partial section views showing additional roller passes of a rolling mill with which the method of the present invention may be associated for multi-stage deformation of a worn rail heated to a plastic state.

DETAILED DESCRIPTION OF PREFERRED EMBODIMENT

Figure 1:
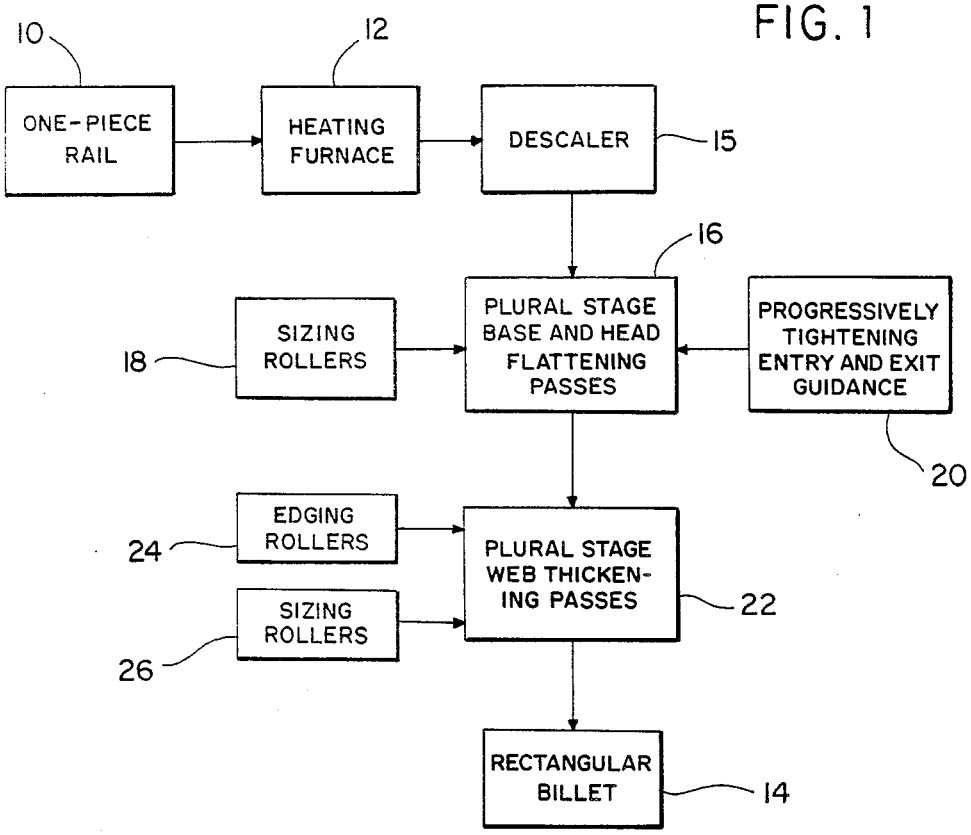
FIG. 1 is a block diagram schematically illustrating the system of the present invention.

Referring now to the drawings in detail, the block diagram of FIG. 1 depicts introduction of a one-piece rail 10, as the workpiece, into a heating furnace 12 of a rolling mill. The workpiece accordingly emerges from the heating furnace in a plastic state before it is fed through a descaler 15 and rolling passes within which the rail 10 is deformed in stages from its original cross-sectional shape to a cross-sectionally rectangular billet 14, by way of example.

An initial group of passes, generally designated 16 in FIG. 1, is formed between sizing rollers 18. Entry and exit from each separate pass is guided with progressively increased friction under control of a guidance control system 20. Within the initial group of separate passes 16, the one-piece rail 10 is flattened only along its base and head portions, leaving the intermediate web portion substantially undeformed.

The flattened slab formation emerging from the group of passes 16 is fed while still in a heated, plastic state to a second group of rolling passes 22 formed between edging rollers 24 and sizing rollers 26. By means of the second group of rolling passes 22, the previously undeformed portion of the workpiece is thickened in stages and somewhat flattened between such stages in order to emerge as the substantially rectangular billet 14, as will be described in greater detail hereinafter.

Figure 2:
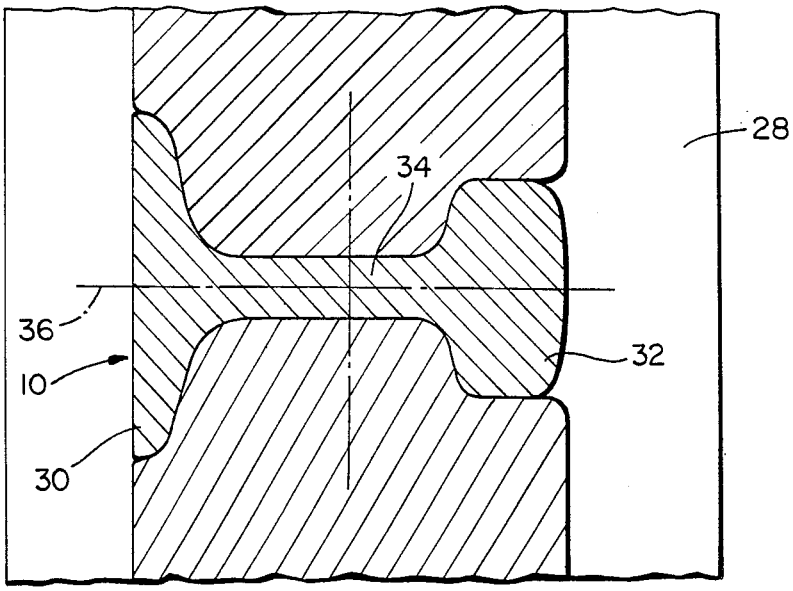
FIG. 2 is a partial section view through an entry guide associated with a rolling mill for use in accordance with the present invention.

Referring now to FIG. 2, the one-piece rail 10 constituting the work being processed in accordance with the present invention, is shown held on its side between entry guiding rollers 28 under an adjusted frictional bias. Work guiding rollers of such type and control thereof is already well known as disclosed for example in U.S. Pat. No. 4,123,927 to Brauer. The guiding rollers 28 are accordingly profiled for frictional contact with the rail 10 of a well known cross-sectional shape which includes a base portion 30, a head portion 32, and a flat web portion 34 spacing the base and head portions along a geometrical axis 36 of the rail. The rail 10 is fed along a plane containing the axis 36 in a direction perpendicular to the plane of the paper on which FIG. 2 is drawn.

Figure 4:
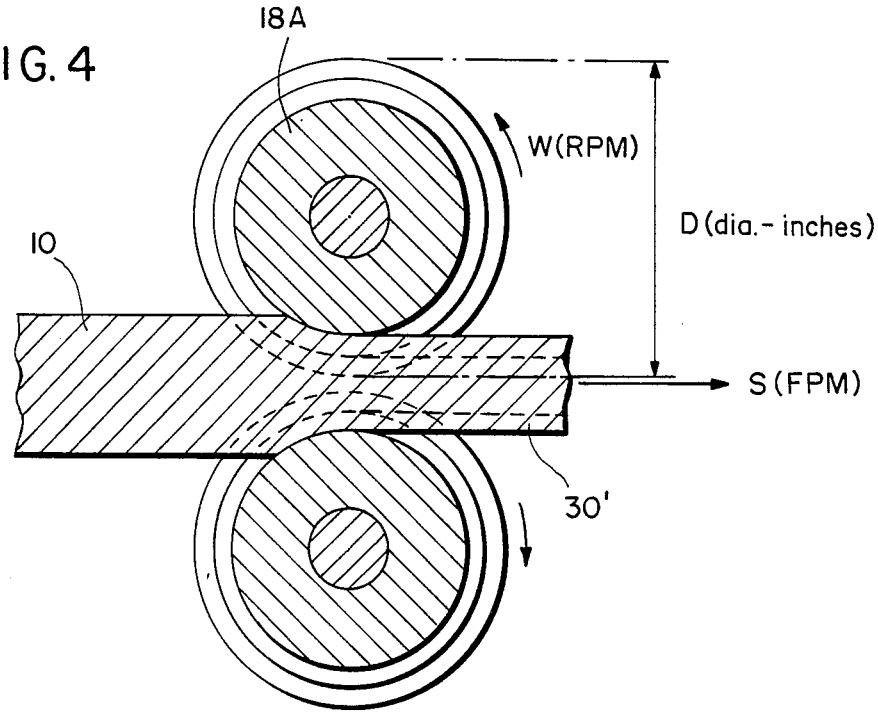
FIG. 4 is a transverse section view taken substantially through a plane indicated by section line 4—4 in FIG. 3.
Figure 3:
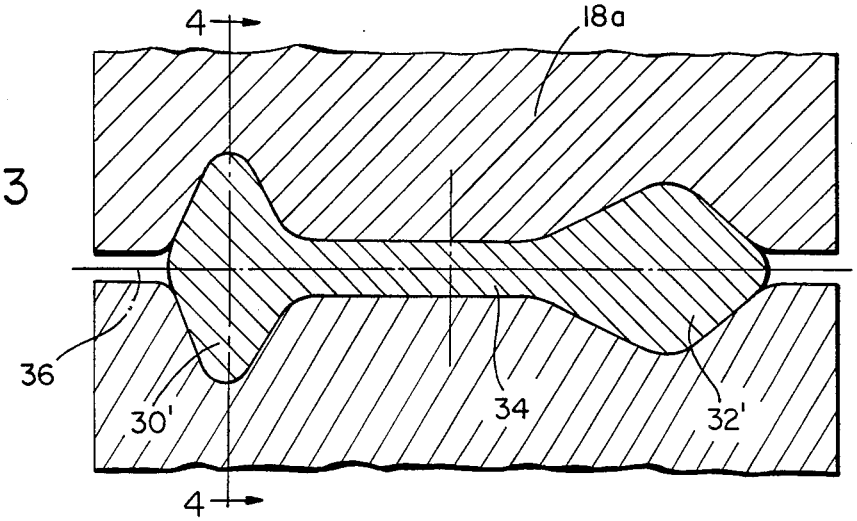
FIG. 3 is a partial section view through a roller sizing pass adapted to be utilized in connection with the method of the present invention.
Figure 4:
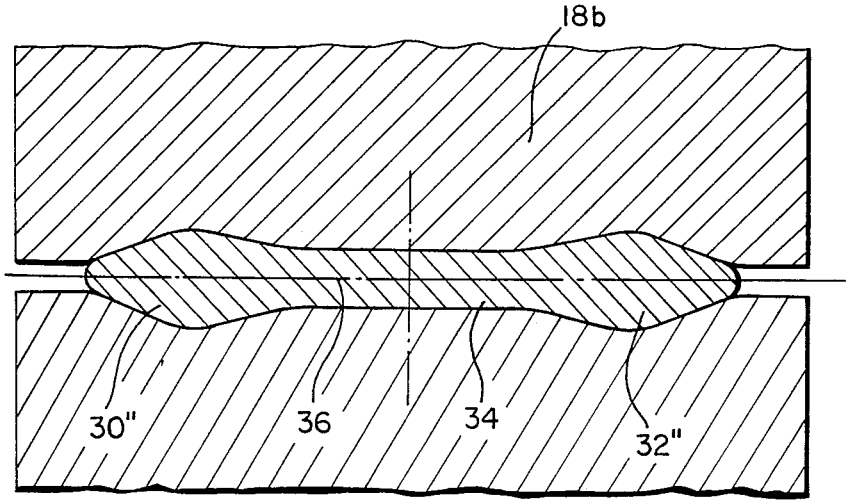

The heated rail 10 is fed between the entry guide rollers 28 into a first rolling pass after it emerges from the descaler 15 aforementioned. In accordance with one embodiment of the invention, the rail 10 being made of steel enters the first pass at a temperature of 2,100° F. As depicted in FIG. 3, the first pass is formed between sizing rollers 18A profiled to effect an initial reduction in height of the base and head portions from the axis 36 of the rail with a corresponding elongation along the axis 36 of the flattened base and head portions 30' and 32'. In accordance with one embodiment of the invention, the sizing rollers 18A as shown in FIG. 4 have a diameter (D) of 17" and are rotated at an angular speed (W) of 19 rpm. The workpiece rail 10 travels through the first pass between the sizing rollers 18A at a linear speed of 43.64 feet per minute (fpm).

During movement of the rail through the first pass as depicted in FIGS. 3 and 4, no work or deformation is performed with respect to the web portion 34 of the rail, which is maintained substantially symmetrical with respect to its axis 36 as a result of the action of the guiding rollers 28 both at the entry and exit of the pass. According to the specific embodiment, hereinbefore pointed out with respect to FIG. 4, the power expended in deforming the base and head portions of the rail is 187 horsepower (hp).

Frictional guidance for the initially deformed rail is tightened under control of the guidance system 20, aforementioned, during feeding movement of the rail through the second pass formed between sizing rollers 18B, as depicted in FIG. 5. As shown, the base and head portions 30" and 32" of the rail are further reduced in height or flattened by engagement between the sizing rollers 18B while the web portion 34 remains undeformed. The sizing roller 18B are also 17" in diameter as in the case of the rollers 18A, and are rotated at an increased speed of 26 rpm, corresponding to an increased work travel speed for the rail of 114.65 fpm. The workpiece emerging from the second pass will accordingly be in the shape of a flattened slab elongated in the direction of axis 36. Thus, the initial group of base and head flattening passes 16, aforementioned in connection with FIG. 1, is established by at least two passes respectively depicted in FIGS. 3 and 5.

Figure 6:
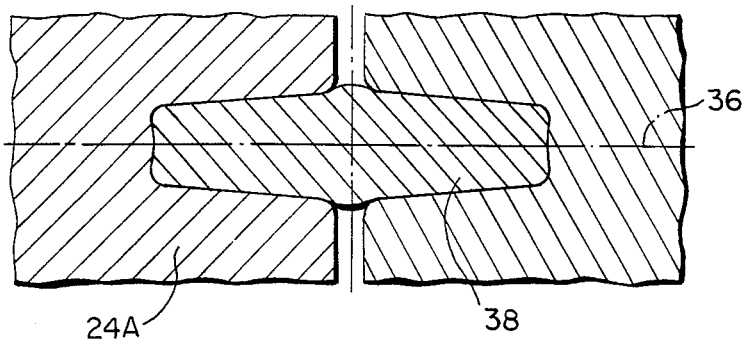

The flattened slab emerging from the first group of passes 16 enters a third pass depicted in FIG. 6, representing the first pass of the second group 22 hereinbefore referred to in connection with FIG. 1. The third pass shown in FIG. 6 is formed between a pair of edging rollers 24A, engageable with the edges of the entering slab. As a result of the deformation caused by the edging rollers 24A, the slab is centrally thickened along the original rail axis 36 at which the web portion 34 was located. The thickened slab 38 as shown in FIG. 6, in accordance with the specific embodiment, is formed by edging rollers 24A having a diameter of 18" and an angular speed of 49 rpm. The deformation performed by the rollers 24A involves power consumption in the amount of 281 hp. Further, the temperature of the work 38 remains above 1,900° F. so that it emerges from the third pass while still in a plastic state for continued deformation within at least four more passes as respectively depicted in FIGS. 7, 8, 9 and 10.

Figure 7:
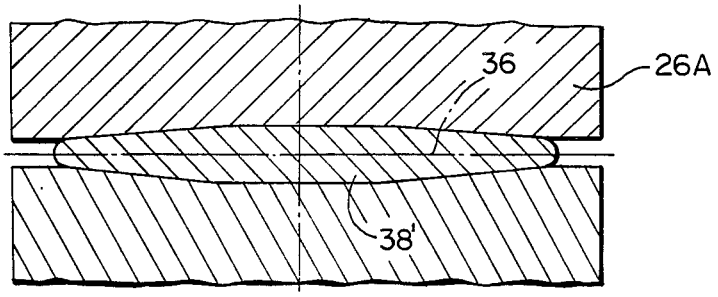

As shown in FIG. 7, the thickened slab is centrally flattened and elongated along the original rail axis 36 by engagement between sizing rollers 26A. The sizing rollers 26A, in the illustrated embodiment, are 17" in diameter and are rotated at a speed of 59 rpm. The thickened slab is deformed to the shape 38' with a power consumption of 341 hp.

Figure 8:
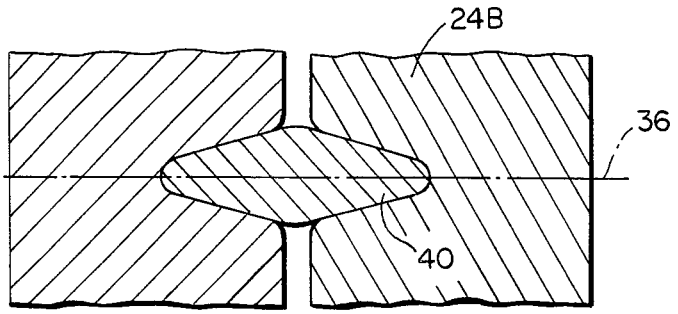

The work 38' emerging from the fourth pass depicted in FIG. 7, undergoes extrusion in a fifth pass depicted in FIG. 8 by engagement with edging rollers 24B having a diameter of 12". The work is accordingly deformed into a cross-sectional shape 40 in which the work slab is further thickened with a corresponding dimensional reduction along the axis 36, as shown in FIG. 8. The power consumed in deforming the work between the edging rollers 24B is 256 hp for the embodiment disclosed.

Figure 9:
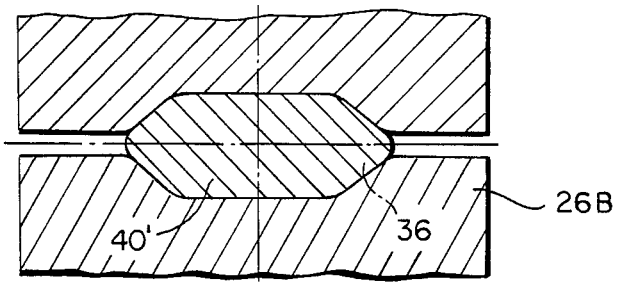
Figure 10:
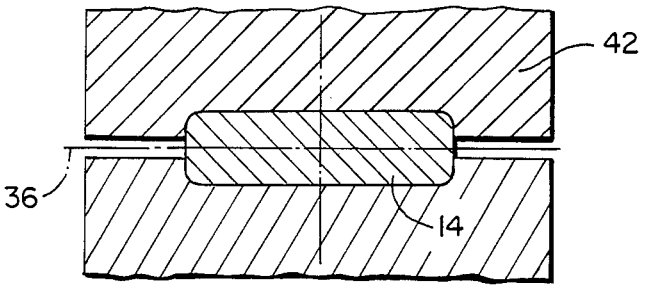

The deformed workpiece 40 emerging from the fifth pass is flattened along the web portion within the sixth pass between sizing rollers 26B as shown in FIG. 9, as the cross-sectional shape of the workpiece 40' approaches the cross-sectionally rectangular shape of the billet 14 produced within the seventh pass between sizing rollers 42 depicted in FIG. 10. The sizing rollers 26B and 42 in the illustrated embodiment are 14" in diameter. Within the sixth pass depicted in FIG. 9 the sizing rollers 26B are rotated at 127 rpm to perform the flattening operation with a power consumption of 81 hp. Final shaping of the workpiece to the rectangular billet 14, as shown in FIG. 10, is performed by rotation of the sizing rollers 42 at a speed of 10.5 rpm as the work travels at a speed of 575 fpm. Power consumption is substantially increased in the final seventh pass to a value of 384 hp.

During the initial web thickening pass depicted in FIG. 6, use of edging rollers for deformation of the work 38 prevents buckling under the conditions hereinbefore specified. During the following pass depicted in FIG. 7, the flattening of the thickened slab 38' prepares it for subsequent deformation without folding. Accordingly, the rectangular billet 14 produced by deformation in the succeeding passes, respectively depicted in FIGS. 8, 9 and 10, is performed under the specified conditions thereby avoiding the quality defects aforementioned in connection with the prior art.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In a method of recycling a one-piece rail having a base portion and a head portion spaced from each other along an axis by a substantially flat web portion, said method comprising heating the rail to a plastic state, feeding the heated rail between sizing and edging rollers to deform the same into a cross-sectionally useful billet, said feeding step including an initial group of rolling passes successively flattening only the base portion and the head portion of the rail between the sizing rollers to extend the web portion along said axis to form an elongated slab and then feeding the elongated slab to a second group of rolling passes alternating between edging rollers and sizing rollers where the slab is initially centrally thickened by edging rollers to prevent buckling and then ultimately forming said billet.

2. The method of claims 1 wherein said initial group of rolling passes includes feeding the heated rail through at least two separate rolling passes during which engagement of the sizing rollers is limited to the base and head portions of the rail to avoid deformation of the web portion.

3. The method of claim 2 further including the steps of: guiding entry and exit of the heated rail through each of said rail flattening passes with progressively increased frictional bias.

* * * * *